US005514432A

United States Patent [19]

Lisec

[11] Patent Number: 5,514,432

[45] Date of Patent: May 7, 1996

[54] HOLLOW PROFILE FOR SPACER FRAMES FOR INSULATING GLASS PANES

[76] Inventor: Peter Lisec, Bahnhofstrasse 34, A-3363 Amstetten-Hausmening, Austria

[21] Appl. No.: 136,082

[22] Filed: Oct. 14, 1993

[30] Foreign Application Priority Data

Jul. 14, 1993 [AT] Austria ..... 1395/93

[51] Int. Cl.[6] ..... E06B 3/663

[52] U.S. Cl. ..... 428/35.8; 428/36.9; 428/36.91; 428/126; 428/34; 248/208; 52/172; 52/309.13; 52/730.4; 52/731.3; 52/786.13

[58] Field of Search ..... 428/34.1, 36.9, 428/36.92, 38, 34, 126, 35.8, 36.91; 52/308, 314, 475, 656.5, 309.1, 309.13, 172, 171.3, 790, 788, 789, 730.4, 731.2, 731.3, 731.4, 732.1, 732.2, 732.3, 786.13; 49/401; 248/208; 156/100, 198, 204, 200, 202, 216, 227

[56] References Cited

U.S. PATENT DOCUMENTS

| | | | |
|---|---|---|---|
| 4,222,213 | 9/1980 | Kessler | 52/172 |
| 4,223,499 | 9/1980 | Schrunk | 428/38 |
| 4,299,639 | 11/1981 | Bayer | 428/38 |
| 4,343,758 | 8/1982 | Goralnik | 428/38 |
| 4,411,115 | 10/1983 | Marzouki et al. | 52/309.1 |
| 4,608,796 | 9/1986 | Shea, Jr. | 52/204.595 |
| 4,718,213 | 1/1988 | Butterfield | 52/732.1 |
| 5,094,055 | 3/1992 | Berdan | 52/790 |
| 5,313,762 | 5/1994 | Guillemet | 52/788 |

FOREIGN PATENT DOCUMENTS

| | | |
|---|---|---|
| 388547 | 7/1989 | Austria . |
| 0223511 | 5/1987 | European Pat. Off. . |
| 1838449 | 12/1960 | Germany . |
| 1095475 | 12/1960 | Germany . |
| 2127173 | 12/1971 | Germany . |
| 3403275 | 8/1985 | Germany . |
| 8608418.6 | 6/1986 | Germany . |
| WO86/01248 | 2/1986 | WIPO . |
| WO92/08030 | 5/1992 | WIPO . |
| WO93/19274 | 9/1993 | WIPO . |

*Primary Examiner*—Ellis P. Robinson
*Assistant Examiner*—Rena L. Dye
*Attorney, Agent, or Firm*—Young & Thompson

[57] ABSTRACT

A hollow profile (1) that can be used as a spacer for insulating glass panes, consists of a metal strip with a U-shaped cross section that forms, with its crosspiece (6), outside wall (2) and, with its side parts (8, 10), folded over inward, side walls (4) of the hollow profile (1). The inside wall (3) of the hollow profile (1) is formed by the crosspiece (15) of a plastic strip with a hat-shaped cross section. The plastic strip has side parts (17) which are secured, with edges (18) folded over outward, on side walls (4) by clamping them in the space between side parts (8) and inward-folded edges (10) of the metal strip. The hollow profile can be produced continuously by a roll shaping process from a metal strip and from a plastic strip.

2 Claims, 2 Drawing Sheets

HOLLOW PROFILE FOR SPACER FRAMES FOR INSULATING GLASS PANES

The invention relates to a hollow profile for spacer frames for insulating glass panes with two side walls parallel to one another to be turned toward the glass panes of the insulating glass pane, an inside wall and an outside wall.

BACKGROUND OF THE INVENTION

Hollow profiles for spacer frames for insulating glass panes are known in the most varied embodiments. Thus, in addition to extruded hollow profiles, hollow profiles produced by roll molding from a metal strip are also known. As the material for the hollow profile, mainly aluminum is used in addition to steel sheet.

A profile for spacer frames has also become known that has a U-shaped cross section and consists of a crosspiece forming the outside wall and two side parts adjacent to the glass panes of the insulating glass pane.

The spacer frames produced from the mentioned hollow profiles have not only the task of keeping both glass panes of an insulating glass pane together, at a distance from one another, but also are used for holding a desiccant that is put into the hollow space of the hollow profile to absorb water vapor contained inside an insulating glass pane so the insulating glass panes cannot show condensation on the inside.

In the mentioned hollow profile with U-shaped cross section, desiccant integrated into an adhesive is to be applied on the inside of the crosspiece forming the outside wall, to fulfill the function of absorbing water vapor.

The drawback of the known profile with the basically U-shaped cross section is that it has only limited stability, so that insulating glass panes produced with it are not stable and, in particular when compression molding the insulating glass panes, problems result. Inherently, the profile with U-shaped cross section has the advantage, when used as a spacer, that heat transmission through the insulating glass pane by thermal conduction is limited to the cross section area of the crosspiece of the profile.

A drawback of the known U-shaped profile consists also in that when the adhesive in which the desiccant is integrated becomes embrittled, the adhesive detaches from the inside surface of the crosspiece of the profile and the inside of the insulating glass pane becomes dirty.

SUMMARY OF THE INVENTION

The object of the invention is to indicate a profile of the above-named type that does not have the drawbacks of known profiles with U-shaped cross section and still reduces heat transmission by thermal conduction.

According to the invention, this object is achieved in that the outside wall and both side walls of the hollow profile consist of metal and in that the inside wall of the hollow profile consists of plastic.

In the hollow profile according to the invention, there is a hollow space in which, as usual and advantageous up to now, desiccant can be held, specifically in an amount such that its capacity to absorb water vapor is sufficient for keeping the insulating glass pane dry. Another advantage consists in that, because of the inside wall made of plastic, the stability of the hollow profile is considerably improved compared to a profile with U-shaped cross section and not only is the handling of the hollow profile during production and processing of the spacer frames improved, but the stability of the insulating glass pane produced using them is improved.

DESCRIPTION OF THE PREFERRED EMBODIMENTS

In a preferred embodiment, it is provided that the outside wall and both side walls are a one-piece metal strip with U-shaped cross section.

The stability of the hollow profile according to the invention is improved further by folding the metal strip over, inward, in the area of the side walls of the hollow profile.

A preferred embodiment of the hollow profile according to the invention, is characterized in that the inside wall of the hollow profile is the crosspiece of a plastic strip with U-shaped cross section that is inserted into the metal strips forming the outside wall and the side walls of the hollow profile. With this embodiment it proves successful for the side parts of the plastic strip to be secured on the side parts of the metal strip forming the side walls of the hollow profile.

In an especially easily producible and stable embodiment of the hollow profile according to the invention, it is provided that the side parts of the plastic strip forming the inside wall are folded over, outward, and, with their exposed edges, are received in the folds of the side walls of the metal strip.

To facilitate the lengthwise folding of the plastic strip forming the inside wall, it can be provided that, at the points where the plastic strip forming the inside wall is folded lengthwise, linear thinner sections, like integral hinges, are provided.

For producing the hollow profile according to the invention there are various possibilities. A process that is preferred in the context of the invention consists in shaping the plastic strip into a U along lines running parallel to its lengthwise direction and in bending outward the exposed edges of the side parts of the plastic strip bent into a U-shape, in folding the edges of the metal strip over onto the exposed, laterally projecting edges of the plastic strip, and in shaping the metal strips, by bending down the folded edges, into a U, causing the exposed edges of the side parts of the plastic strip that are supported in the edge folds of the metal strip to be folded over, outward.

With this method, which can be performed, for example, in a roll molding machine, it proves successful in the context of the invention if the plastic strips are shaped, by pushing together their edges that are separated from the rest of the plastic strip by lengthwise fold lines, into the basic U-shape with laterally projecting edges.

DESCRIPTION OF THE DRAWINGS

Further details and advantages of the hollow profile according to the invention come out from the following description of the drawings, in which embodiments of the invention are represented. There are shown in.

Figure 1:
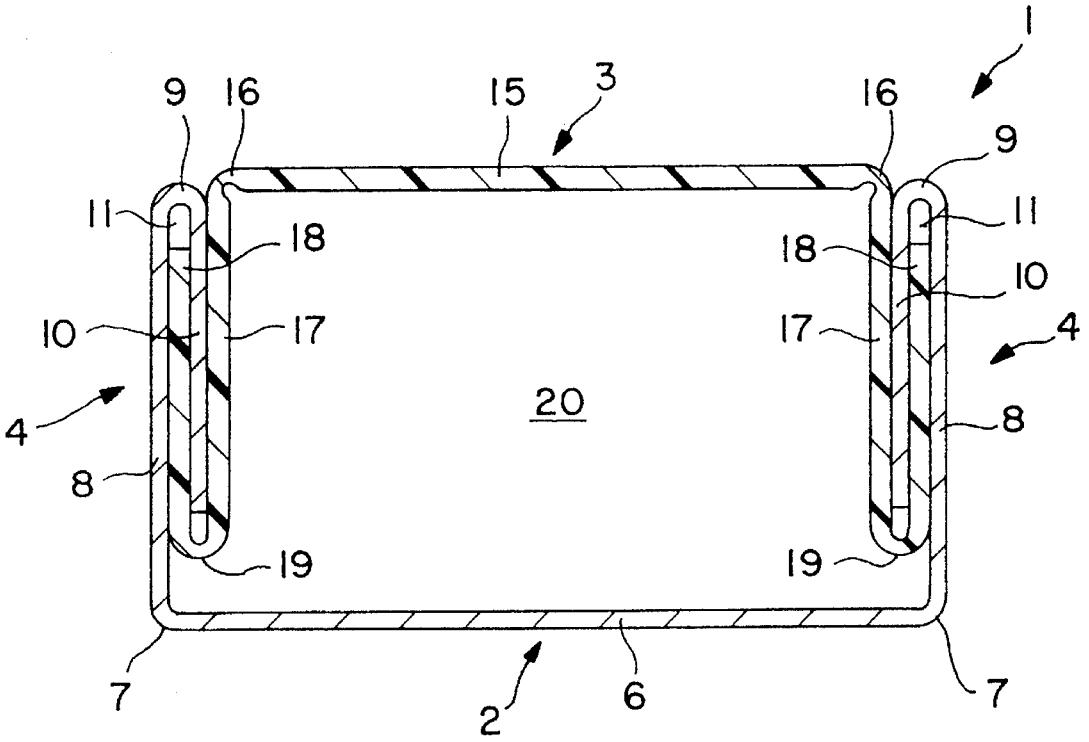
FIG. 1, a hollow profile in cross section and FIG. 2, the production stages of a hollow profile according to the invention.

The hollow profile shown in FIG. 1 has a basically rectangular cross section with an outside wall 2, an inside wall 3 and two side walls 4. Side walls 4 are those parts of hollow profile 1 by which the latter is attached to both glass panes of an insulating glass pane, for the purpose of which, in a way known in the art, an adhesive layer is applied on the outside of side walls 4. Of course, the hollow profile according to the invention is not limited to the basically rectangular cross section represented, but the hollow profile according to the invention can also have the cross section of a so-called ."economical profile."

Outside wall 2 and both side walls 4 are made from a metal strip whose crosspiece 6 forms the outside wall, in contrast to which both its side parts 8 form side walls 4. Here, side parts 8 are made integral with crosspiece 6 by lengthwise bending sites 7.

Exposed edge areas 10 of side parts 8 are folded over, inward, around bending sites 9 running lengthwise so that, between side parts 8 and parts 10, folded over and inward, of side parts 8, a space 11 remains open.

Inside wall 3 consists of a plastic strip that is also made basically U-shaped and whose crosspiece 15 forms the inside wall. Edge areas of the plastic strip that forms inside wall 3 are separated from its crosspiece by lengthwise-running thinner sections that are like integral hinges 16, so the plastic strip can easily be bent down to give it a basically U-shaped cross section. Here, both side parts 17 lie against the inside surface of edge areas 10 of the metal strip and are, for their part, folded over, outward, in their edge areas 18. The folding over of side parts 17 is facilitated by lengthwise-running thinner lines 19.

Because of the design shown in FIG. 1 of a hollow profile 1, it can be seen that edge areas 18 of the plastic strip forming inside wall 3, in the area of side walls 4 of hollow profile 1, are secured in a clamplike way.

Because inside wall 3 consists of plastic, it contributes practically nothing to heat transmission, since plastics are heat-insulating.

Further, there exists the possibility of coloring inside wall 3 simply by suitable tinting of the plastic border, so the hollow profile, in the area in which it is visible after installation in the insulating glass pane, i.e., its inside wall 3, can be matched colorwise to the respective installation conditions.

It can further be seen that desiccant that develops its desiccating effect by perforations (not shown) in the area of inside wall 3 (crosspiece 15 of the plastic strip) can be placed in the usual way in inside space 20 of hollow profile 1. Another advantage consists in that plastic strip 3, because it is secured with its outside edges 18 in the area of side walls 4 of the metal strip, makes the profile resistant to warping and stiffened against twisting.

Further, the hollow profile according to the invention, because of inside wall 3, is stable against pressure on side walls 4, so it can easily be coated in the usual devices with adhesive or sealing compound and the assembled insulating glass pane can be press molded in the usual presses with the commonly used molding pressure.

Because fold lines are indicated by thin sections 16, 19 in the plastic strip that forms inside wall 3, the plastic itself can be produced of comparatively stiff material and have a suitable wall thickness to give hollow profile 1 the desired stiffness.

Figure 2A:
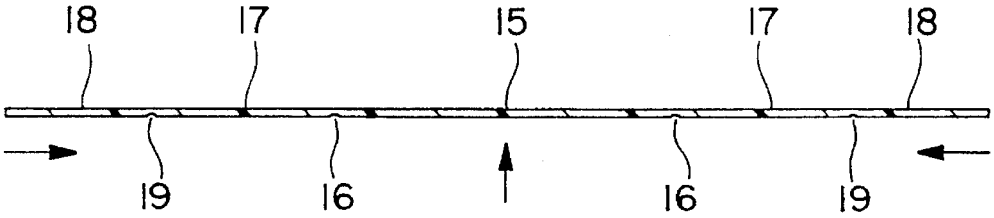
Figure 2B:
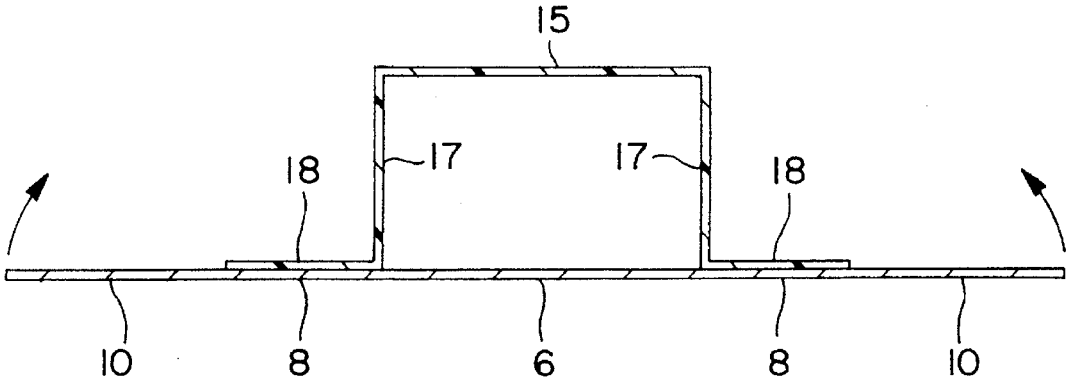
Figure 2C:
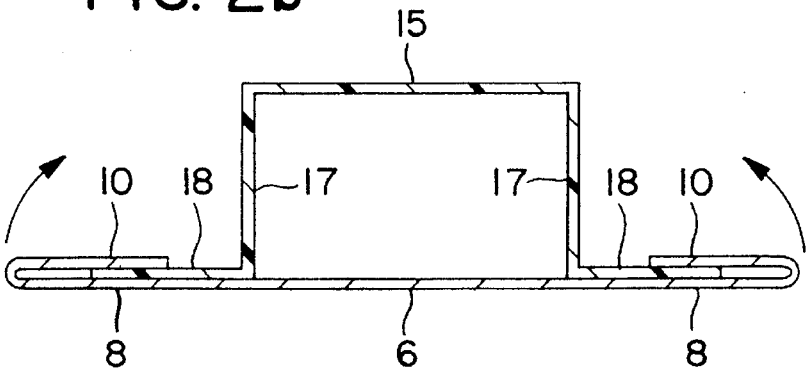
Figure 2D:
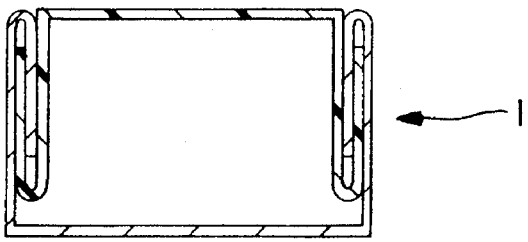

In the process for producing a hollow profile according to the invention shown, for example, in FIG. 2, a strip made of plastic is shaped, with its sections 15, 17, 18 and lengthwise fold lines 16 and 19 (FIG. 2*a*), into the cross section shape shown in FIG. 2*b*, i.e., U-shaped with laterally projecting edge strips 18 ("hat profile") by moving edge strips 18 toward the center and area 15 (in FIG. 2) upward. The plastic strip shaped this way is aligned with a metal strip, oriented symmetrically with its lengthwise center plane, and then exposed edges 10 of the metal strip, as indicated in FIG. 2*b*, are folded over inward. Then, as indicated in FIG. 2*c*, the edges of the metal strip consist of areas 8 and 10 with, clamped between them, edge strips 18, bent upward, of the plastic strip, and edge strip 18 is folded outward so that finished hollow profile 1 shown in FIG. 2*d* and FIG. 1 is finally achieved.

All these work steps can be performed, for example, in a roll mold device in the continuous process.

In summary, the invention can be represented as follows:

A hollow profile 1 that can be used as a spacer for insulating glass panes consists of a metal part with a U-shaped cross section, a metal part that forms, with its crosspiece 6, outside wall 2 and, with its side parts 8, 10, folded over inward, side walls 4 of hollow profile 1. Inside wall 3 of hollow profile 1 is formed by crosspiece 15 of a plastic strip with a U-shaped cross section, a plastic strip whose side parts 17 are secured, with edges 18 folded over outward, on side walls 4 by clamping them in the space between side parts 8 and inward-folded edges 10.

The hollow profile can be produced continuously in the roll mold process from a metal strip and from a plastic strip.

What is claimed is:

1. Hollow profile (1) for spacer frames for insulating glass panes with two side walls (4) parallel to one another for facing the glass panes of the insulating glass pane, an inside wall (3) and an outside wall (2), the outside wall (2) consisting of metal and the inside wall (3) consisting of plastic, the outside wall (2) and the inside wall (3) being folded over each other to form the side walls (4) of the hollow profile (1), such that the layers (8, 18, 10, 17) which form said side walls (4) lie against each other in midportions of each said side wall, each said side wall consisting of only four layers, namely, an outermost metal layer (8), next a plastic layer (18), next a metal layer (10), and finally an innermost plastic layer (17), said metal layers (8, 10) being integral with said outside wall (2) and said plastic layers (18, 17) being integral with said inside wall (3).

2. Hollow profile according to claim 1, wherein, at lengthwise bend lines of the plastic strip, thinner hinge sections (16, 19) are provided.

* * * * *